United States Patent [19]

Hunn

[11] 4,300,742

[45] Nov. 17, 1981

[54] CANE HOLDER

[76] Inventor: Douglas C. Hunn, 4000 W. 88th St., Bloomington, Minn. 55437

[21] Appl. No.: 65,123

[22] Filed: Aug. 9, 1979

[51] Int. Cl.[3] ..... F16M 13/00

[52] U.S. Cl. ..... 248/360; 248/226.5; 248/316 R; 248/316 D

[58] Field of Search ..... 135/20 R, 65, 66; 24/257, 263 R; 248/226.1, 226.2, 226.5, 229, 359, 360, 539, 540, 541, 558

[56] References Cited

U.S. PATENT DOCUMENTS

| | | | |
|---|---|---|---|
| 250,328 | 11/1881 | Hughes . | |
| 526,184 | 9/1894 | Gilbert | 135/65 |
| 976,638 | 11/1910 | Corey | 135/65 |
| 1,068,273 | 7/1913 | Reed | 248/359 X |
| 1,329,915 | 2/1920 | McKenzie | 135/65 |
| 2,287,485 | 6/1942 | Pierce | 248/359 |
| 2,653,616 | 9/1953 | Selgas | 248/226.5 X |
| 2,896,896 | 7/1959 | Revzin | 248/229 |
| 2,910,208 | 10/1959 | Doyle | 248/359 X |
| 2,912,991 | 11/1959 | Shinn . | |
| 2,920,369 | 1/1960 | Zezula | 248/226.1 X |
| 2,988,310 | 6/1961 | Wright | 248/229 X |
| 3,179,436 | 4/1965 | Choy . | |
| 3,286,963 | 11/1966 | Bergman | 248/257 X |

FOREIGN PATENT DOCUMENTS

| | | |
|---|---|---|
| 503168 | 7/1930 | Fed. Rep. of Germany . |
| 443368 | 7/1912 | France . |

*Primary Examiner*—William H. Schultz

*Attorney, Agent, or Firm*—Merchant, Gould, Smith, Edell, Welter & Schmidt

[57] ABSTRACT

In the preferred embodiment, cane (110) is held to the cane holder by means of a clamp (134) and an adapter (138), and is further tensioned in place by an adjustment block (136) which is adjustable by selection of pairs of grooves (154, 156, 158) and lands (140). The cane holder is removably held to a table top, or the like, by means of clamp wings (114, 116) which are slidably adjustable inside slots in the main body (150) of the device. The clamp wings are held at acute angles so that when they are brought together on both sides of a table top (102), they will be biased against the table top and create a solid, yet removable attachment.

16 Claims, 9 Drawing Figures

FIG. 1
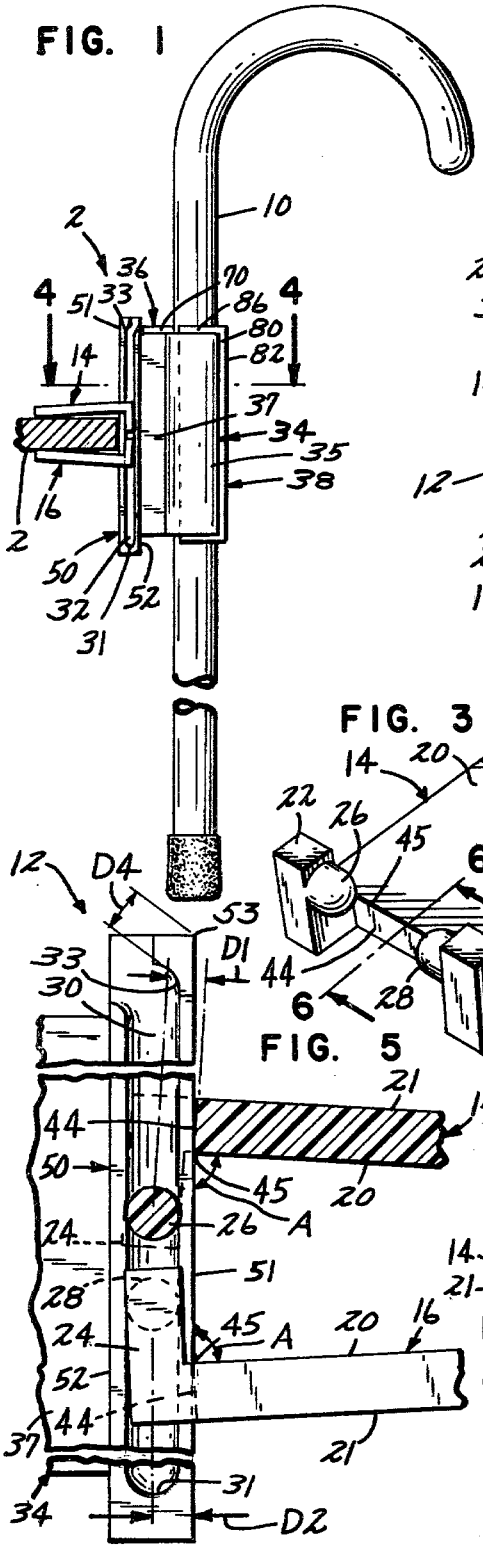
FIG. 2
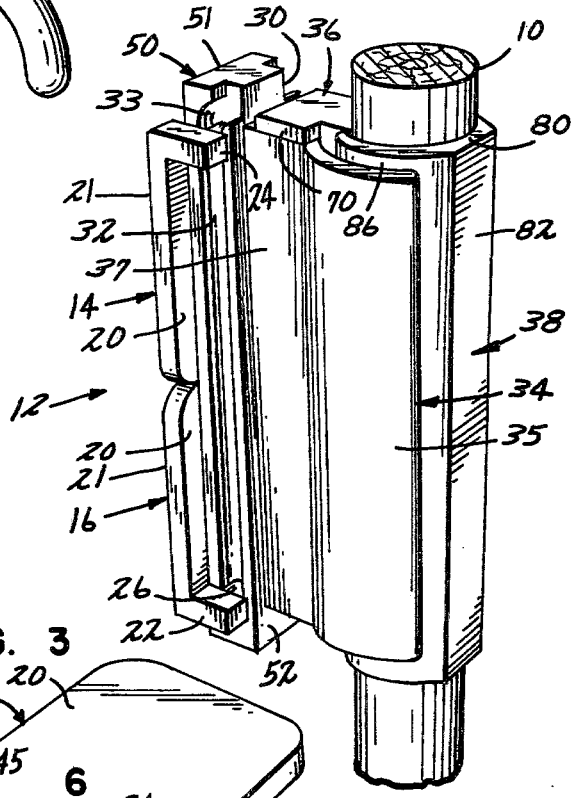
FIG. 3
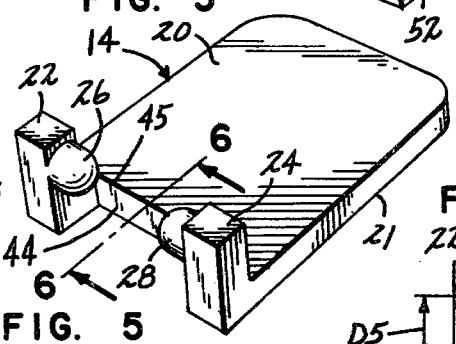
FIG. 5
FIG. 6
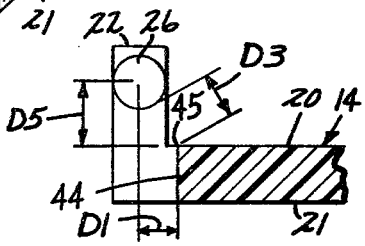
FIG. 4
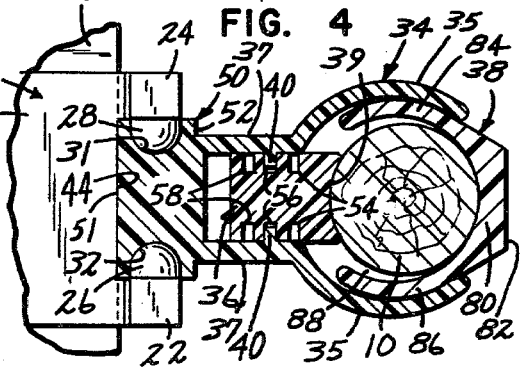

CANE HOLDER

TECHNICAL FIELD

The present invention relates to portable clamping devices for removably fixing walking canes, poles, crutches, etc., to tables or the like.

BACKGROUND OF THE INVENTION

Historically, portable cane holders have consisted of devices which are permanently attached to the cane and rely on the cane's center of gravity and balance to keep it in a vertical position when held at the edge of a horizontal support such as a table. These devices lack positive clamping means to assure that the cane does not fall over and to eliminate the need for relying on the cane's own balancing capabilities. Additionally, these devices do not take into account varying cane diameters.

SUMMARY OF THE INVENTION

The present invention comprises an improved cane, crutch or pole holder which is removably attached to the cane itself, and provides positive clamping means by which the cane is held in a vertical position against the edge of a table or similar horizontal structure. The cane holder remains on the cane during use and transport. When it is desired that the cane be clamped to a table, a pair of clamping wings are unfolded, adjusted to be spaced slightly larger than the width of the table edge, applied to the table and then the wings are pressed together, whereupon they are biased against the table so that the cane is held securely thereto.

Various advantages and features of novelty which characterize the invention are pointed out with particularity in the claims annexed hereto and forming a part hereof. However, for a better understanding of the invention, its advantages, and objects attained by its use, reference should be had to the drawings which form a further part hereof, and to the accompanying descriptive matter, in which there is illustrated and described a preferred embodiment of the invention.

BRIEF DESCRIPTION OF THE DRAWINGS

Referring to the drawings, wherein like numerals indicate like elements:

FIG. 1 is a side view of the cane holding device clamped to a table top with a cane in place;

FIG. 2 is an enlarged perspective view of the cane holding device with part of the cane showing;

FIG. 3 is a perspective view of an element of the invention;

FIG. 4 is a section taken along the line 4—4 of FIG. 1 to a larger scale;

FIG. 5 is an enlarged fragmentary elevational view of the main body and clamp wings of the holding device with portions broken away and shown in section;

FIG. 6 is a section taken along line 6—6 of FIG. 3;

DETAILED DESCRIPTION OF THE INVENTION

Figure 7:
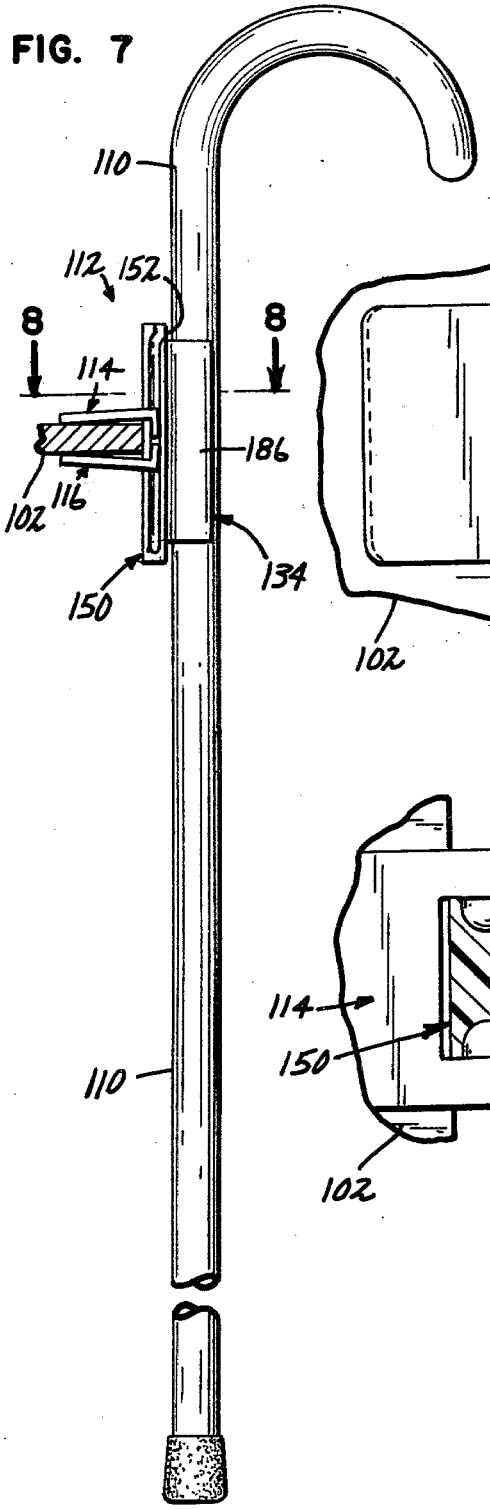
FIG. 7 is a side view of a second embodiment of the cane holding device clamped to a table top with a cane in place.

In FIGS. 1–6, cane holder 12 comprises a main body 50, a C-shaped clamp 34, a pair of clamp wings 14 and 16 made of slightly resilient material for engaging a support surface such as table 2, and an adjustment block 36 for cooperating with C-clamp 34 to frictionally retain a cane 10. Except for canes of maximum diameter, holder 12 also includes an adapter clamp 38.

The main body 50 is shown to comprise a thin elongated base having opposite surfaces 51 and 52, having slots 30 and 32 extending along its opposite edges, and having a C-shaped clamp 34, defining portions of a cylindrical portion having its axis aligned with main body 50, and of internal radius generally equal to that of the largest cane to be held. Clamp 34 includes a pair of curved portions 35 which are spaced from the main body 50 by a pair of walls 37 having internal lands 40 directly opposing each other and extending into the area defined by the main body 50 and walls 37.

As shown in FIG. 5, slot 30 is closed at its bottom end 31. Slot 32 is similarly constructed as shown in FIG. 1. At their top ends slots 30 and 32 terminate in partial curves 33 toward C-clamp 34, to lessen the chance of the clamp wings 14 and 16 sliding out of slots 30 and 34 and becoming lost when the clamp wings are in a storage position to be described. Partial curves 33 act as a sort of angular buffer which requires a change in the orientation of the clamp wings relative to the main body in order to remove them from the main body.

Clamp wings 14 and 16 are identical and only one will be described in detail. Clamp wing 14 is shown to have a pair of flat surfaces 20 and 21. At one end the wing is provided with recess 44. Recess 44 intersects surface 20 along a line 45. Arms 22 and 24 rise from one surface of the wing to support cylindrical guide pins 26 and 28. The lengths and diameters of the pins are generally the same as the depths and widths of slots 30 and 32. The length of the main body 50 is such that slots 30 and 32 are not shorter than the combined length of wings 14 and 16. Distance D3 shown in FIG. 6, measured from the periphery of pin 26 to line 45 is slightly greater than the distance D4 shown in FIG. 5 measuring the widest distance from corner 53 on the main body to the inside surface of curvature 33. This geometric limitation permits the cane holder to be assembled as explained below. Distance D5, FIG. 6, measured from the center of pin 26 to a plane including surface 20 must be generally equal to distance D2, FIG. 5. This limitation helps prevent the loss of the clamp wings by cooperating with curves 33 to prevent the clamp wings from sliding off the main body when in their storage position, as will be explained hereinafter.

Block 36 is of proper cross-section to fit in the space between walls 37 and has one edge 39 of generally concave configuration in section. Pairs of grooves 54, 56 and 58 extend along opposite faces of block 36 to receive lands 40 and thus to position the block with edge 39 extending into the space defined by clamp 34 by different distances. The upper end of block 36 has a stop-flange 70 wider than the space between walls 37.

The cylindrical boundary defined by C-clamp 34 has an open space. Adapter clamp 38 is configured to be received within clamp 34 in order to produce a completely enclosed substantially cylindrical area of smaller radius. It comprises a central, somewhat thickened portion 80 having a generally flat outer surface 82 and a pair of arcuate members 84 and 86 configured to be received within clamp 34 and to define an inner concavity 88. The length of adapter clamp 38 is generally the same as the length of clamp 34.

To assemble the holder, clamp wing 16 is positioned so that its recess 44 faces surface 52 of the main body 50. Guide pin 28 is then aligned with slot 30. The clamp wing is then simultaneously slid in the slots toward end closure 31 while it is rotated so that recess 44 faces surface 51 of the main body. The other clamp wing 14 is inserted in a similar fashion except in reverse, i.e. so that pin 26 is aligned with slot 30.

Clamp wings 14 and 16 are such that the distance D1 measured from the center of pin 26 to recess 44 is slightly less than the distance D2 measured from the mid-point of slot 30 to the outer edge 51 of the main body 50. The same relationship of D1 and D2 is maintained for all four guide pins with respect to slots 30 and 32. Thus angle A measured from surface 20 on clamp 14 to surface 51 of body 50 is always less than 90 degrees, except, of course, if the clamp wings are caused to bend when biased against a clamping surface.

Clamp 16 may similarly be adapted to maintain an angle of less than 90°, although for most clamping purposes only one clamp wing need be restricted to less than 90° while the remaining wing can be perpendicular with the main body.

Even though angle A is less than 90°, the resiliency of the clamp wings allows them to be biased against a table surface or the like such that the clamp wings are at right angles to the main body. It is this resiliency which holds the cane holder fixed to the table.

To operate this embodiment, cane shaft 10 is inserted within the adapter 38. Adapter 38 is then inserted within C-clamp 34. To increase the tension with which adapter 38 holds the cane, block 36 can be adjusted so that lands 40 are received within slots 58. To reduce the tension slots 54 should be selected. Various size adapter clamps can be made to match the wide variety of cane diameters manufactured. In some cases, the cane shaft will have a diameter sufficient to be snugly engaged within C-clamp 34 without the use of the adapter clamp 38. In such a case, adapter 38 may be dispensed with.

The clamp wings 14 and 16 are foldable from a "clamping" position as shown in FIGS. 1 and 5 to a "storage" position as in FIG. 2. In order to fasten the cane and holder to a table top, clamp wings 14 and 16 are unfolded as shown in FIG. 5. They are then slidably spaced apart slightly wider than the thickness of the support surface. The clamp wings are then located on either surface of the support surface and the clamp wings are then pressed toward each other. The resilience of the material and tensioning effect created by the differential between distances D1 and D2 causes the clamp wings to pinch the support surface from above and below, thereby holding the cane holder solidly to the table. To remove the cane holder from the table top, the holder 2 can be pulled horizontally away from the table, thus disengaging the wings, or one of the clamp wings can be forced along the slots 30 and 32, away from the table top, to loosen the engagement.

Figure 8:
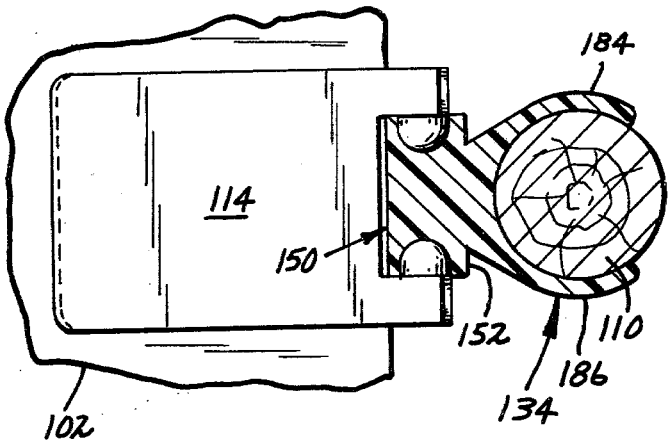
FIG. 8 is a section taken along the line 8—8 of FIG. 7.
Figure 9:
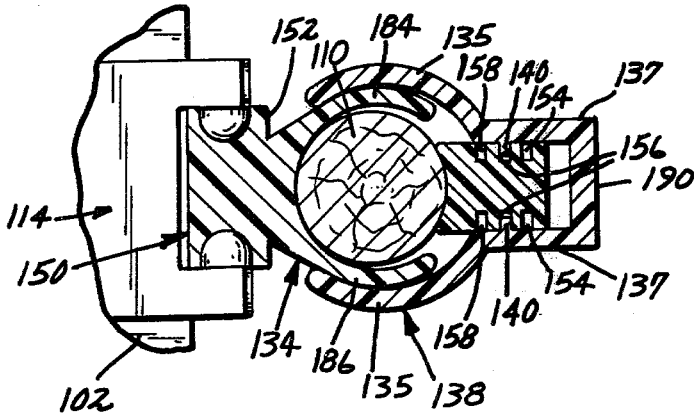
FIG. 9 is a top sectional view, with portions broken away, of the second embodiment of the cane holding device with an adapter in place.

In a preferred embodiment as shown in FIGS. 7, 8 and 9, cane holder 112 comprises a main body 150, a C-shaped resilient clamp 134, and a pair of clamp wings 114 and 116 made of slightly resilient material for engaging a support surface such as table 102. Except for canes of maximum diameter holder 112 also includes an adapter clamp 138, having an adjustment block 136 cooperating with clamp 138 and C-clamp 134 to frictionally retain cane 110.

In this embodiment main body 150 and clamp wings 114 and 116 correspond to main body 50 and clamp wings 14 and 16. Therefore, except where otherwise noted, the first embodiment and preferred embodiment are substantially identical and the structure in the preferred embodiment will not be reiterated.

In this preferred embodiment arcuate members 184 and 186 extend from surface 152 of main body 150 and are configured to receive cane 110.

For canes of less than maximum diameter, an adapter clamp 138 is employed which has a substantial planar portion 190 of length somewhat less than the length of body 150. Extending outward from and perpendicular to portion 190 are a pair of spaced walls 137. Extending from walls 137 are curved portions 135 configured to receive arcuate portions 184 and 186. Walls 137 have internal lands 140 projecting therefrom. Adjustment block 136 is of proper cross section to fit in the space between walls 137 and has one edge 139 of generally concave configuration in section. Pairs of grooves 154, 156 and 158 extend along opposite faces of block 136 to receive lands 140 and thus position the block with edge 139 extending into the space defined by clamp 134 by different distances. The upper end of block 136 may have a stop flange (not shown) wider than the space between walls 137 and substantially identical to stop flange 70 of the first embodiment.

The cylindrical boundary defined by C-clamp 134 has an open space. Adapter clamp 138 is configured to receive arcuate members 184 and 186 in order to produce a completely enclosed substantially cylindrical area of smaller radius.

Assembly of the holder is substantially identical to assembly described in the first embodiment with respect to the clamp wings. Once the clamp wings are in place, cane 110 is inserted within clamp 134. If the cane is of sufficient diameter it is snugly received within clamp 134 and adapter clamp 138 is not needed. If cane 110 is of lesser diameter, adapter clamp 138 with adjustment block in place as shown in FIG. 9 is added so that curved portions 135 of clamp 138 envelop arcuate portions 184 and 186. The tension by which the cane is held within the cane holder is determined by the selection of grooves 154, 156 or 158 within lands 140.

It should be noted that while a cane holder is described, the device is capable of holding crutches or poles of various shapes, not limited to cylinders.

From the foregoing, it will be evident that a cane holding device has been invented which is light-weight, portable, and adaptable to various sizes of canes, crutches or the like, and provides a positive clamping to a table top or the like.

Numerous characteristics and advantages of my invention have been set forth in the foregoing description, together with details of the structure and function of the invention, and the novel features thereof, are pointed out in the appended claims. The disclosure, however, is illustrative only, and changes may be made in detail, especially in matters of shape, size, and arrangement of parts, within the principle of the invention, to the full extent indicated by the broad general meaning of the terms in which the appended claims are expressed.

What is claimed is:

1. A holding device for removable attachment of an elongated object to a support surface, comprising:

(a) a main body member having front and rear faces and left and right sides;

(b) first and second clamp wings, having front and rear ends, each of said clamp wings having guide pin means affixed thereto for slideable engagement with said body member, said clamp wings being pivotable from a clamping position and a storage position;

(c) means formed in said body member for slideably receiving said guide pin means;

(d) means affixed to said rear face of said body member for removably holding the elongated object;

(e) a first circular clamp made of elastic material attached to said rear face of said body member;

(f) a second circular clamp made of elastic material capable of snugly receiving said object within said second clamp and said second clamp being capable of being snugly received within said first clamp; and (g) said first clamp including means for adjusting the tension by which said second clamp is snugly received within said first clamp.

2. A device according to claim 1 wherein the adjusting means includes an adjustment block held within an enclosed space by said first clamp for protrusion of said block into said space.

3. A device according to claim 2 wherein said first clamp includes a pair of opposing lands spaced apart for holding said block and wherein said block contains a plurality of pairs of opposing grooves for receiving said lands whereby the protrusion of said block into said space may be adjusted by selection.

4. Apparatus for securing an elongated object such as a cane in generally vertical orientation to a generally horizontal support having spaced upper and lower surfaces, such as the edge of a table, comprising a main body and a pair of resilient supporting wings, said main body comprising (a) an elongated base member having a longitudinal axis and including first and second ends, first and second opposite faces and first and second opposite edges having longitudinal slots of predetermined depth and width extending therealong parallel to said first surface and spaced therefrom by a predetermined distance, and (b) a pair of clamping members extending in generally the same direction from said first face in a mutually spaced relationship to make up a clamping member of generally C-shaped section in a plane perpendicular to said longitudinal axis;

each of said support wings each comprising (a) a generally flat body having first and second opposite surfaces and first and second opposite ends, said first ends having a central recess, (b) a pair of arms extending from said first surface at the ends of said recess, and (c) a pair of coaxial pivot pins projecting over said recess from said arms, the diameters and lengths of said pins being equal to the widths and depths of said slots in said base member, the distance between the bottom of said recess and the plane passing through the axis of said pins and perpendicular to said first surface to said axis of said pins being generally the same as, the distances from the centers of said slots to said second face of said base member, said wings being positioned on said base member with said pivot pins in said slots for sliding movement therealong and for pivotal movement between first positions, in which said first faces of said wings lie along said second face of said base member, and second positions, in which said first faces of said wings are in apposition and extend outward from said second face of said base member at slightly less than 90°.

5. Apparatus according to claim 4 including an adjustment member located between said clamping members and of length generally equal to the breadth of said clamping members, and having a pair of opposite faces and a pair of opposite edges, said faces and said edges extending generally parallel to said axis, said faces being mutually spaced by the distance between said flat portions of said gripping arms, and having grooves for receiving said lands of said flat portions so that said adjustment member may be slidably received between said flat portions with said concave surface in one of the discontinuities of said hollow cylinder.

6. Apparatus according to claim 4 including adapter member of generally C-shaped transverse section having a central portion and a pair of mutually spaced end portions, for outwardly engaging said arcuate portions of said clamping members and inwardly engaging the object to be secured, the central position of said adapter closing the space between the ends of said clamping members, and said adjusting member engaging the surface of said object through the space between said end portions of said adapter.

7. Apparatus according to claim 4 including an adjustment member located between said clamping members and of length generally equal to the breadth of said members, and having a pair of opposite faces and a pair of opposite edges, said faces and said edges extending generally parallel to said axis, said faces being mutually spaced by the distance between said flat portions of said gripping arms, and having grooves for receiving said lands of said flat portions so that said adjustment member may be slidably received in the space between said flat portions with said concave surface in one of the discontinuities of said hollow cylinder, and an adapter member of length comparable to the breadth of said clamping members and of generally C-shaped transverse section having a central portion and a pair of mutually spaced end portions, for outwardly engaging said arcuate portions of said gripping arms and inwardly engaging the object to be secured, the central portion of said adapter closing the space between the ends of said clamping members, and said adjusting member engaging the surface of said object through the space between said end portions of said adapter.

8. a device according to claim 1 wherein adjusting means includes an adjustment block held within an enclosed space by said first clamp for protrusion of said block into said space.

9. A device according to claim 8 wherein said first clamp includes a pair of opposing lands spaced apart for holding said block and wherein said block contains a plurality of pairs of opposing grooves for receiving said lands whereby the protrusion of said block into said space may be adjusted by selection.

10. Apparatus for securing an elongated object such as a cane in generally vertical orientation to a generally horizontal support having spaced upper and lower surfaces, such as the edge of a table, comprising a main body and a pair of resilient supporting wings, said main body comprising (a) an elongated base member having a longitudinal axis and including first and second ends, first and second opposite faces and first and second opposite edges having longitudinal slots of predetermined depth and width extending therealong parallel to said first surface and spaced therefrom by a predetermined distance, and (b) a pair of arcuate portions extending in generally the same direction from said first face in mutually spaced relationship to make up a clamping member of generally C-shaped section in a plane to said longitudinal axis;

each of said support wings each comprising (a) a generally flat body having first and second opposite surfaces and first and second opposite ends, said first end having a central recess, (b) a pair of arms extending from said first surface at the ends of said recess, and (c) a pair of coaxial pivot pins projecting over said recess from said arms, the diameters and lengths of said pins being equal to the widths and depths of said slots in said base member, the distance between the bottom of said recess and the plane passing through the axis of said pins and perpendicular to said first surface to said axis of said pins being generally the same as, the distance from the centers of said slots to said second face of said base member, said wings being positioned on said base member with said pivot pins in said slots for sliding movement therealong and for pivotal movement between first positions, in which said first faces of said wings lie along said second face of said base member, and second positions, in which said first faces of said wings are in apposition and extend outward from said second face of said base member at slightly less than 90°.

11. Apparatus of claim 10 including an adapter member, partially encompassing said arcuate portions, of length generally equal to the breadth of such arcuate portions and having a flat planar member, flat portions, and curved portions, said flat portions extending generally perpendicular to said planar member and including lands projecting from the inner surface thereof and extending parallel to said planar member, and said curved portions extending from said flat portions in mutual apposition to form discontinuous diametrically opposite portions of a hollow cylinder, to make up a member of generally C-shaped section.

12. Apparatus according to claim 11 including an adjustment member located between said curved portions and of length generally equal to the breadth of said curved portions, and having a pair of opposite faces and a pair of opposite edges, said faces being mutually spaced by the distance between said flat portions of said curved portions, and having grooves for receiving said lands of said flat portions so that said adjustment member may be slidably received between said flat portions with said concave surface in one of the discontinuities of said hollow cylinder.

13. Apparatus for securing an elongated object such as a cane in generally vertical orientation to a generally horizontal support having spaced upper and lower surfaces, such as the edge of a table, comprising a main body and a pair of resilient supporting wings, said main body comprising (a) an elongated base member having a longitudinal axis and including first and second ends, first and second opposite faces and first and second opposite edges having longitudinal slots of predetermined depth and width extending therealong parallel to said first surface and spaced therefrom by a predetermined distance, said slots being closed at like first ends and terminating at second ends in curves opening toward said first face, and (b) a pair of arcuate portions extending in generally the same direction from said first face in mutually spaced relationship, said members comprising a central portion affixed to said first face and arcuate portions for inwardly engaging the object to be secured, said arcuate portions extending from said flat portions in mutual apposition to form discontinuous diametrically opposite portions of a hollow cylinder, to make up with said base member a clamping member of generally C-shaped section in a plane to said longitudinal axis;

said support wings each comprising (a) a generally flat body having first and second opposite surfaces and first and second opposite ends, said first end having a central recess, (b) a pair of arms extending from said first surface at the ends of said recess, and (c) a pair of coaxial pivot pins projecting over said recess from said arms, the diameters and lengths of said pins being equal to the widths and depths of said slots in said base member, the distance between the bottom of said recess and the plane passing through the axis of said pins and perpendicular to said first surface being slightly less than, and the distance from said first surface being slightly less than, and the distance from said first surface to said axis of said pins being generally the same as, the distance from the centers of said slots to said second face of said base member, said wings being positioned on said base member with said pivot pins in said slots for sliding movement therealong and for pivotal movement between first positions, in which said first faces of said wings lie along said second face of said base member, and second positions, in which said first faces of said wings are in apposition and extend outward from said second face of said base member at slightly less than 90°.

14. Apparatus of claim 13 including an adapter member partially encompassing said arcuate portions of length generally equal to the breadth of such arcuate portions and having a flat planar member, flat portions, and curved portions, said flat portions extending generally perpendicular to said planar member and including lands projecting from the inner surface thereof and extending parallel to said planar member and said curved portions extending from said flat portions in mutual apposition to form discontinuous diametrically opposite portions of a hollow cylinder, to make up a member of generally C-shaped section.

15. Apparatus according to claim 14 including an adjustment member located between said curved portions and of length generally equal to the breadth of said curved portions, and having a pair of opposite faces and a pair of opposite edges, said faces and said edges extending generally parallel to a plane parallel to said planar member, one of said edges being concave transversely of said plane, said faces being mutually spaced by the distance between said flat portions of said curved portions, and having grooves for receiving said lands of said flat portions so that said adjustment member may be slidably received in the space between said flat portion with said concave surface in one of the discontinuities of said hollow cylinder.

16. A holding device for removable attachment of an elongated object to a support surface, comprising:

(a) a main body member having front and rear faces and left and right sides;

(b) first and second clamp wings, having front and rear ends, each of said clamp wings having guide pin means affixed thereto for slideable engagement with said body member, said clamp wings being pivotable between a clamping position and a storage position, (c) means formed in said body member for slideably receiving said guide pin means;

(d) means affixed to said rear face of said body member for removably holding the elongated object;

(e) a first circular clamp made of elastic material;

(f) a second circular clamp made of elastic material attached to said rear face of said body member, capable of snugly receiving said object within said second clamp and said second clamp being capable of being snugly received within said first clamp; and (g) said first clamp includes means for adjusting the tension by which said second clamp is snugly received within said first clamp.

* * * * *